US005199216A

United States Patent [19]

Vetter et al.

[11] Patent Number: 5,199,216

[45] Date of Patent: Apr. 6, 1993

[54] FRENCH CASEMENT WINDOW OPERATOR

[75] Inventors: Gregory J. Vetter, Owatonna; Daniel G. Tucker, Waseca, both of Minn.

[73] Assignee: Truth Div. of SPX Corporation, Owantonna, Minn.

[21] Appl. No.: 899,717

[22] Filed: Jun. 17, 1992

[51] Int. Cl.[5] ..... E05F 17/00

[52] U.S. Cl. ..... 49/109; 49/110; 49/116; 49/118; 49/367

[58] Field of Search ..... 49/109, 110, 114, 111, 49/112, 113, 122, 118, 116, 107, 108, 367

[56] References Cited

U.S. PATENT DOCUMENTS

| | | | |
|---|---|---|---|
| Re. 32,846 | 1/1989 | Sandberg et al. . | |
| 274,765 | 3/1883 | Hawkey | 49/114 X |
| 1,247,322 | 11/1917 | Perkins | 49/114 |
| 1,401,202 | 12/1921 | Smith | 49/108 X |
| 2,034,781 | 3/1936 | Strandt | 49/109 |
| 2,560,860 | 7/1951 | Hannegan | 49/109 |
| 3,011,779 | 12/1961 | Reiter | 49/109 |
| 3,838,537 | 10/1974 | Stavenau et al. . | |
| 4,241,541 | 12/1980 | Van Klompenburg et al. . | |
| 4,253,276 | 3/1981 | Peterson et al. . | |
| 4,266,371 | 5/1981 | Erdman et al. . | |
| 4,305,228 | 12/1981 | Nelson . | |
| 4,346,372 | 8/1982 | Sandberg . | |
| 4,497,135 | 2/1985 | Vetter . | |
| 4,674,149 | 6/1987 | Vetter . | |
| 4,726,092 | 2/1988 | Tacheny et al. . | |
| 4,823,508 | 4/1989 | Allen . | |
| 4,840,075 | 6/1989 | Tucker . | |
| 4,862,639 | 9/1989 | Leach et al. | 49/122 |
| 4,932,695 | 6/1990 | Pettit et al. . | |
| 4,937,976 | 7/1990 | Tucker et al. . | |
| 5,040,267 | 8/1991 | Dallmann . | |
| 5,054,239 | 10/1991 | Tucker et al. . | |
| 5,083,344 | 1/1992 | Pettit et al. . | |
| 5,093,960 | 3/1992 | Pemberton . | |

OTHER PUBLICATIONS

Truth Brochure entitled "H/Duty Concealed Casement Hinges" pp. 2-2a.

Truth Brochure entitled "Split Arm Operator" pp. 8-8a.

Truth Brochure entitled "Single Arm Operator (Surface-Mount)".

*Primary Examiner*—Philip C. Kannan

*Attorney, Agent, or Firm*—Wood, Phillips, VanSanten, Hoffman & Ertel

[57] ABSTRACT

An operator for a French casement window having an operating arm with a roller mounted at its end and pivotable to move in an arc between extended and retracted positions, and a channel member horizontally mountable on the inner side of one sash and confining the roller as the operating arm is moved between its extended and retracted positions to move one between open and closed positions, respectively. A bracket is on the inner side of the other sash adjacent its outer vertical side, and a drag link is pivotally connected on one end to the bracket and on the other end to the operating arm to move the other sash between open and closed positions synchronously with the first sash when the operating arm is moved between its extended and retracted positions, respectively. The drag link may be selectively in or out of alignment with the operating arm pivot axis when the sashes are in their closed position, whereby one sash is closed slightly ahead of the other when the sashes are moved to their closed position and the other sash is moved slightly ahead of the one sash when the sashes are moved from their closed position toward their open position. A sealing flange along the middle vertical side of the one sash sealingly engages the inner side of the other sash, and a second sealing flange along the middle vertical side of the other engages the outer side of the one sash, when the sashes are in their closed position.

18 Claims, 2 Drawing Sheets

FRENCH CASEMENT WINDOW OPERATOR

BACKGROUND OF THE INVENTION

1. Technical Field

The present invention is directed toward window operators, and more particularly toward window operators for opening and closing French casement windows.

2. Background Art

Casement windows are well known in the art. Such windows include a window sash mounted within a window frame with top and bottom hinge structures securing the sash within the frame for opening outwardly by generally pivoting about one side of the sash. More specifically, a typical bottom hinge includes a sash arm fixed to the top of the sash and pivotally secured at one end to a sliding shoe. The shoe is guided in its sliding movement by a track extending along the bottom of the window frame. A support arm completes the linkage of the hinge, and is typically pivoted at opposite ends to the sash arm and the track. Such hinges are shown, for example, in U.S. Pat. Nos. 4,593,431 (Re. 32,846) and 5,040,267. Other variations of such hinges are also shown, for example, in U.S. Pat. Nos. 3,838,537, 4,674,149, 4,726,092, 5,083,344, and 5,093,960.

Operators controlling movement of such casement windows are also well known. Various such operators are shown, for example, in U.S. Pat. Nos. 4,241,541, 4,253,276, 4,266,371, 4,305,228, 4,346,372, 4,497,135 4,823,508, 4,840,075, 4,932,695, 4,937,976 and 5,054,239.

French casement windows have two different window sashes within a single frame, each sash supported for movement by hinges such as described above by generally pivoting about their outer vertical sides (adjacent the frame) with the window sashes meeting in the middle of the frame when closed. Frequently, such windows include a fixed mullion in the middle of the frame, with the middle vertical sides of the sashes seating against the mullion to ensure a suitable seal against weather, rain, etc. where the French casement windows meet one another.

It is, however, desirable to maximize the opening through the frame when the sashes are open, not only for aesthetics (maximizing the view and open feel of the window) but also to allow egress through the window in emergency situations. In order to provide these advantages, it is necessary to avoid all obstacles from the middle of the frame, specifically, the above described mullion used in other such windows. However, in such windows it is necessary to overlap the two sashes in the center of the frame in order to ensure that a suitable closure seal is provided.

Of course, as with other casement windows, it is often desirable to provide operators to ease their opening and closing. Typically, two operators are provided with such windows, one for each sash. Such a structure is, of course, inconvenient in that it requires that two different operators be manipulated in order to fully open the window. Further, dual operator structures are not readily usable with French casement windows which do not have a center mullion, since the overlap in the sashes in such windows would result in damage to the window sashes and/or window operators if a person attempted to open or close the wrong sash first.

The present invention is directed toward overcoming one or more of the problems set forth above.

SUMMARY OF THE INVENTION

In one aspect of the present invention, an operator for moving the sashes of a French casement window between their open and closed positions is provided, including a pivotable operating arm having a radial end engageable with one of the sashes to move the one sash between open and closed positions, a drive for pivoting the operating arm about a pivot axis, and a drag link pivotally secured at one end to the operating arm and pivotally secured at its other end to the other sash adjacent the outer vertical side of the other sash, whereby pivoting of the operating arm synchronously moves both of the window sashes between their open and closed positions.

In another aspect of the present invention, the drive includes (1) a base secured on the inner side of the frame adjacent one sash and defining the pivot axis of the operator arm, (2) a driven gear fixed to the operating arm and mounted to the base for pivoting about the pivot axis of the operator arm, (3) a drive gear pivotally mounted to the base and drivably engaging the driven gear, and (4) means for driving the drive gear.

In a further aspect of the invention, a roller is provided on the radial end of the operating arm, and a channel member is horizontally mounted on one sash to confine and be engaged by the roller as the operating arm is pivoted to synchronously move both of the sashes between their open and closed positions.

In other aspects of the present invention, the drag link is substantially in alignment with the pivot axis of the operating arm when the sashes are closed or, alternatively, the drag link is offset from alignment with the pivot axis of the operating arm when the sashes are closed, whereby initial pivoting of the operating arm causes one or the other of the sashes to initially open based on the link alignment and the other sash is closed slightly ahead of the other sash when the sashes are moved to their closed position.

In yet another aspect of the present invention, a sealing flange is provided along one side of the first to close sash adapted to sealingly engage the inner side of the other sash when the sashes are in their closed position.

It is an object of the invention to provide an inexpensive and easy to use window operator for opening and closing both sashes of a French casement window.

It is another object of the present invention to provide a window operator for French casement windows having secure and reliable weathertight seals.

It is yet another object of the present invention to provide a window operator for French casement windows providing a maximum aesthetic open view therethrough when opened.

It is still another object of the present invention to provide a window operator for French casement windows allowing egress therethrough.

It is an object of the present invention to provide a window operator which is usable with a French casement window providing a maximum unobstructed opening.

Yet another object of the present invention is to provide a window operator which will open and close both sashes of a French casement window without danger of damaging the window by improper use of the operator.

DESCRIPTION OF THE PREFERRED EMBODIMENT

Figures 1, 2, 3:
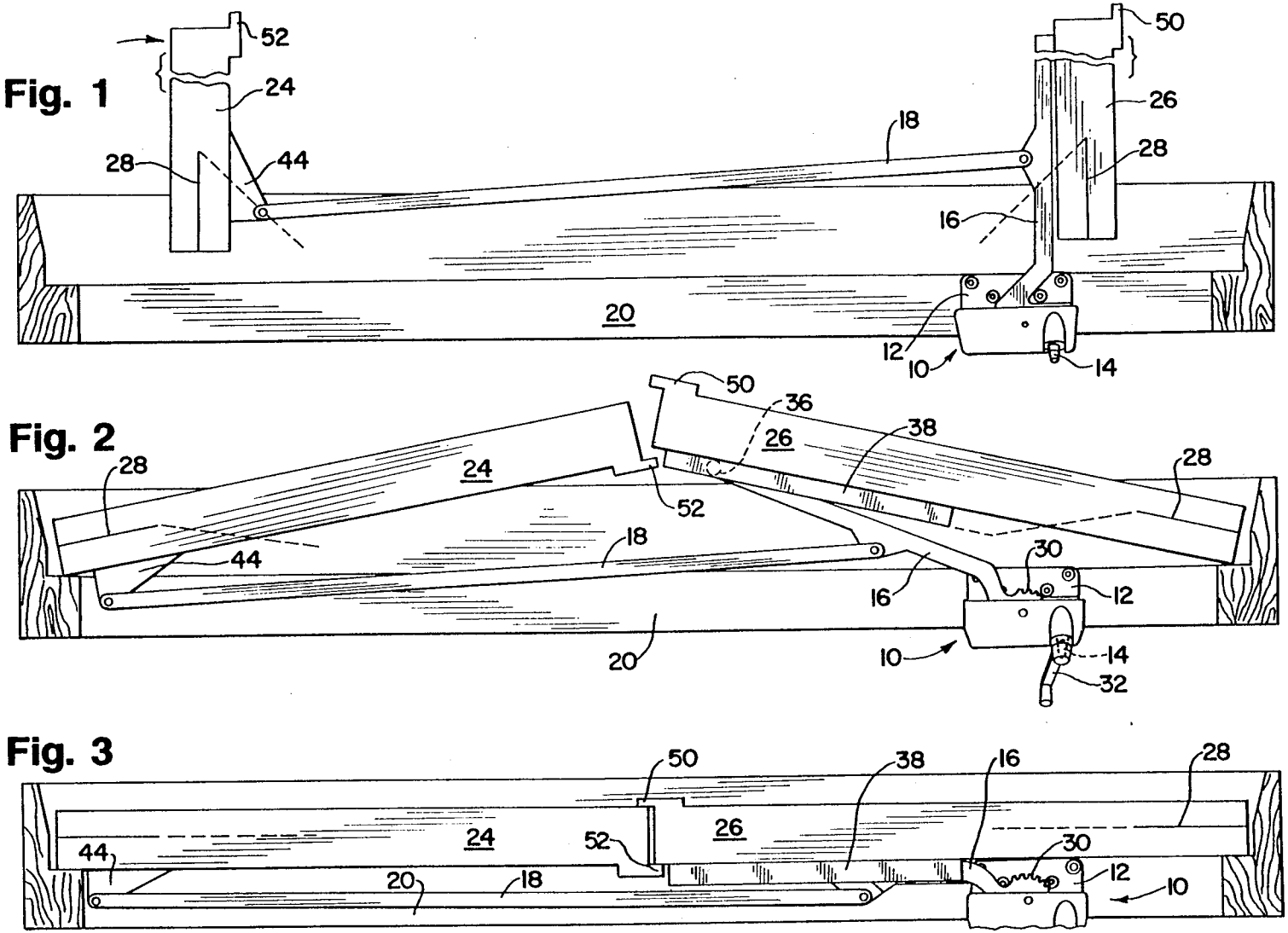
FIG. 1 is a plan view of a first embodiment of the present invention as configured with open French casement windows.
FIG. 2 is a plan view of the FIG. 1 embodiment illustrating the French casement windows near their closed position.
FIG. 3 is a plan view of the FIG. 1 embodiment illustrating the French casement windows in their closed position.

A first embodiment of the French casement window operator 10 of the present invention is shown in FIGS. 1-3. The operator 10 includes a base 12, a rotary drive shaft 14, an operating arm 16, and a drag link 18.

More specifically, the operator base 12 is suitably secured to the bottom of a window frame 20 within which two window sashes 24, 26 are suitably secured by hinges 28 (shown only schematically in the figures) such as shown in U.S. Pat. Nos. 4,593,431 (Re. 32,846) and 5,040,267, the detailed disclosures of which are hereby incorporated by reference. As will be understood by those having skill in the art, such hinges 28 support the sashes 24, 26 on a sash arm which is pivotably supported at one end on a shoe which is slidable along a track on the bottom of the frame 20 and guided in its movement by a link pivoted to the sash arm at one end and to the track at its other end.

The operating arm 16 is pivotably supported at one end to the operator base 12, and preferably includes suitable gear teeth 30 at that end engaging the drive shaft 14 whereby rotation of the drive shaft 14 will pivot the operating arm 16. Typically, a handle (reference numeral 32 in FIG. 2) is secured to the drive shaft 14 for pivoting the drive shaft 14 to move the operating arm 16, although it is also within scope of this invention to provide a suitable electrical motor (reference numeral 34 in FIG. 5) for selectively rotating the drive shaft 14 to control the operator 10 as described hereafter.

The operating arm 16 includes a roller 36 (see FIG. 2) at its other end, which roller 36 is confined in a channel 38 secured to the bottom of one of the sashes 26 such that the end of the operating arm 16 may move laterally of the sash 26 during operating while maintained in engagement therewith. Of course, still other connecting structures could be used within the scope of the invention, including, for example, a slide member and guide track interconnection.

A bracket 44 is fixed to the other sash 24 near its bottom adjacent its hinged side. The drag link 18 is pivotably secured at one end to the bracket 44 and at its other end to an intermediate point on the operating arm 16.

In the FIGS. 1-3 embodiment, the sash 26 connected to the operating arm includes an outer sealing flange 50 along its middle vertical side (that is, the side adjacent the other sash 24 when the window is closed), and the other sash 24 includes an inner sealing flange 52 along its middle vertical side.

The FIGS. 1-3 embodiment is further configured such that, as best seen in FIG. 3, when the sashes 24, 26 are closed, the drag link 18 is substantially axially aligned with the pivot axis of the operating arm 16.

As a result of this configuration as discussed in greater detail hereafter, operation of the FIG. 1-3 embodiment is as follows. When the sashes 24, 26 are open, there is no center mullion and thus a maximum opening is provided to give both the desired open feeling through the window and also to allow egress therethrough should that be required in an emergency.

As the sashes 24, 26 are closed by the operator 10 (with the operating arm 16 pivoted counterclockwise in the figures), the operating arm 16 and the drag link 18 cooperate so that the left sash 24 (the one connected to the drag link 18) is closed slightly ahead of the right sash 26. As a result, the inner sealing flange 52 of the first to close sash 24 is assured of being positioned on the inner side (the side with the operator 10) of the window without abutting the other sash 26, which could interfere with closing.

When the sashes 24, 26 are closed as shown in FIG. 3, the window thus provides a good weather barrier. Not only may the outer sides of the sashes 24, 26 be suitably sealed against the frame 20 in a suitable manner such as is well known in the art, but a good weather seal is also provided between the two sashes 24, 26 at the middle by the abutment of the outer sealing flange 50 with the outer side of the left sash 24 and the abutment of the inner sealing flange 52 with the inner side of the right sash 26.

Still further, when the closed sashes 24, 26 are thereafter opened by the operator 10, the FIG. 1-3 configuration will cause the right sash 26 to initiate opening as is desired due to the arrangement of the sealing flanges 50, 52. Specifically, when the drag link 18 is substantially in alignment with the pivot axis of the operating arm 16 when the sashes 24, 26 are closed as described above, initial pivoting of the operating arm 16 will result in essentially lateral motion of the end of the drag link 18 connected thereto. Such lateral motion of the drag link 18 will essentially tend to initially pivot the drag link 18 about its connection to the bracket 44 with minimal longitudinal force on the drag link 18, and thus minimal initial opening force on the left sash 24. Continued pivoting of the operating arm 16 will then introduce a greater longitudinal force on the drag link 18 to thus synchronously open the two sashes 24, 26 together in a manner that neither sealing flange 50, 52 will engage the other sash 24, 26 to interfere with such motion.

Figure 4:
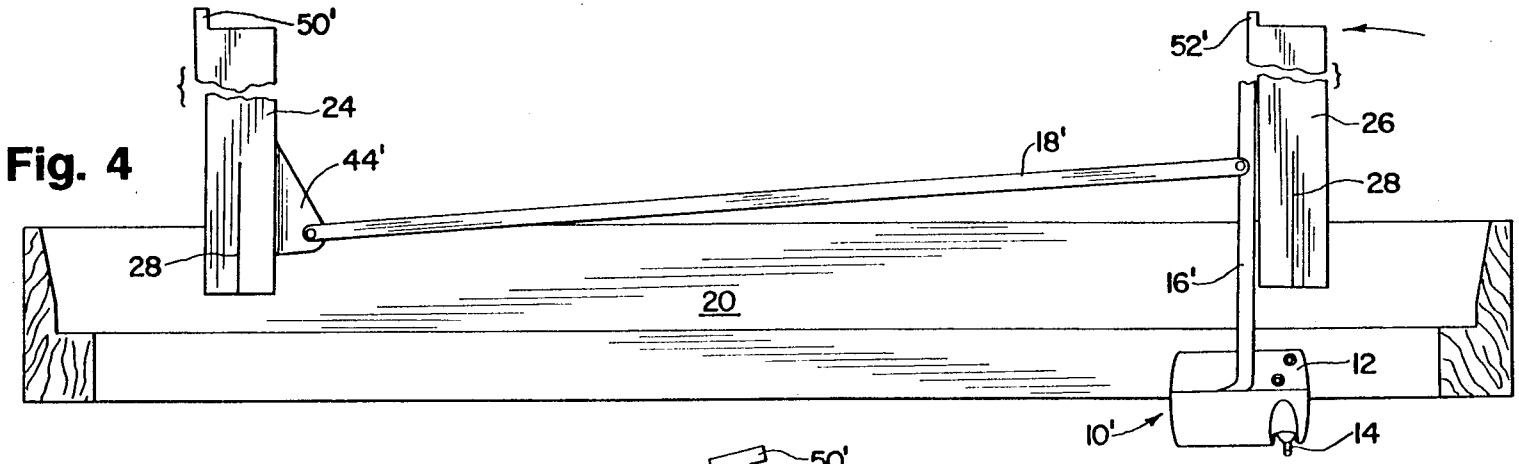
FIG. 4 is a plan view of a second embodiment of the present invention as configured with open French casement windows.
Figure 5:
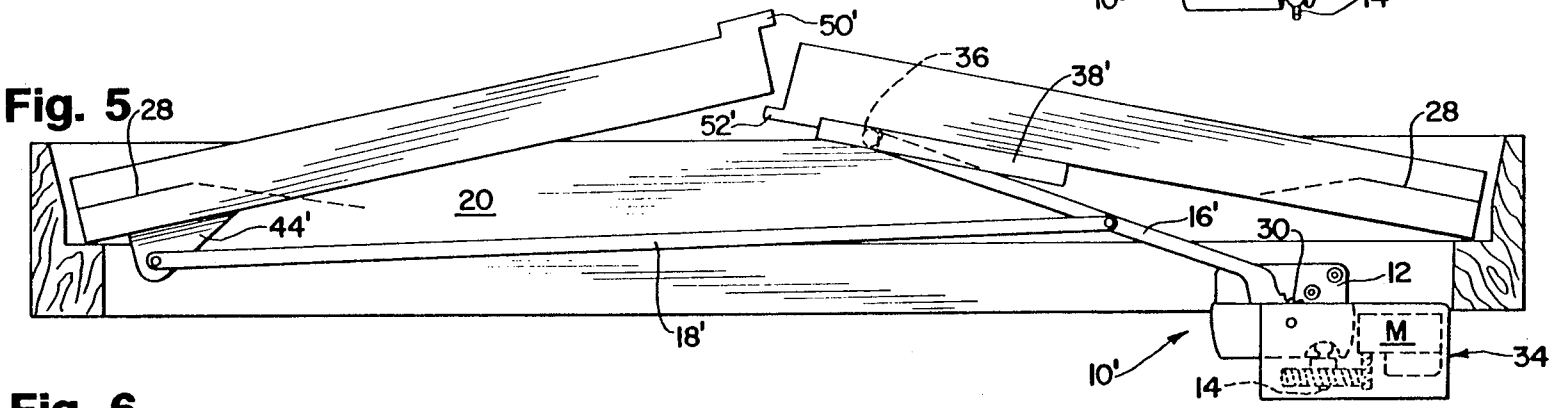
FIG. 5 is a plan view of the FIG. 2 embodiment illustrating the French casement windows near their closed position.
Figure 6:
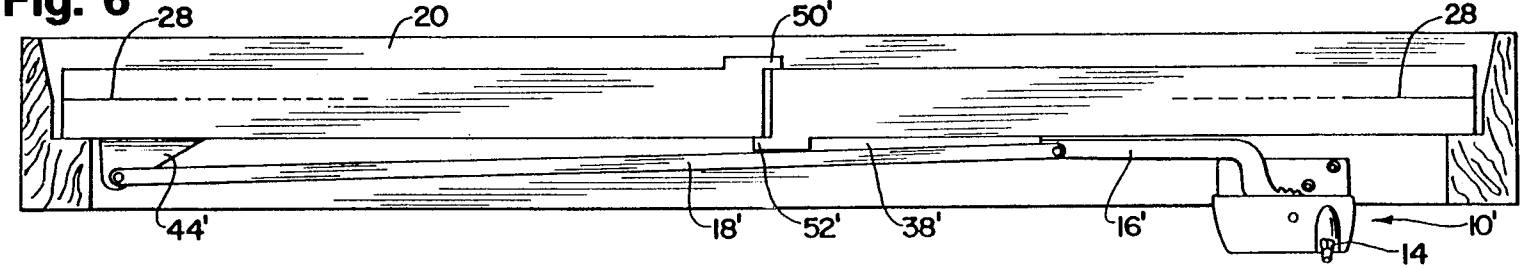
FIG. 6 is a plan view of the FIG. 2 embodiment illustrating the French casement windows in their closed position.

A second embodiment of the present invention is show in FIGS. 4-6. This embodiment has many similar components to the above described FIGS. 1-3 embodiment, and thus identical components are identified by the same reference numbers and modified components are identified by the same reference numbers with prime ("′") added thereto.

More specifically, the FIG. 4-6 embodiment reverses the sealing flanges 50′, 52′, so that the outer sealing flange 50′ is on the left sash 24 and the inner sealing flange 52′ is on the right sash 26 (i.e.. the sash to which the channel 38 is secured).

Also, the drag link 18′ is oriented so that it is longitudinally offset from the pivot axis of the operating arm 16′ when the sashes 24, 26 are closed (see FIG. 6). This may be accomplished in any suitable manner, as by providing a different bracket 44′ and/or connecting the drag link 18′ to a pivot along the longitudinal extent of the operating arm 16′ (versus the offset connection of the FIGS. 1–3 embodiment).

As a result of the above described orientation of the drag link 18′, initial movement of the operating arm 16′ translates into longitudinal movement of the drag link 18′ which pulls on the bracket 44′ and initiates opening of the left sash 24. As a result, opening of the sashes 24, 26 together is accomplished in a manner that neither sealing flange 50′, 52′ will engage the other sash 26, 24 to interfere with such motion.

Similarly, when the sashes 24, 26 are closed by the operator 10′ (with the operating arm 16′ pivoted counterclockwise in the figures), the operating arm 16′ and the drag link 18′ cooperate so that the right sash 26 (the one connected to the operating arm 16′ ) is closed slightly ahead of the left sash 24. As a result, the inner sealing flange 52′ of the first to close sash 26 is assured of being positioned on the inner side (the side with the operator 10′) of the window without abutting the other sash 24, which could interfere with closing.

Of course, the above described motion of the FIGS. 4–6 embodiment also permits the window to be configured without a center mullion, thus providing a maximum opening to give both the desired open feeling through the window and also to allow egress therethrough should that be required in an emergency. At the same time, when the sashes 24, 26 are closed as shown in FIG. 6, the window still provides a good weather barrier around all sides of the sashes 24, 26, including at the middle of the window by the abutment of the outer sealing flange 50′ with the outer side of the right sash 26 and the abutment of the inner sealing flange 52′ with the inner side of the left sash 24.

Thus, it should now be apparent that window operators made according to the present invention are inexpensive and easy to use with French casement windows. Further, such operators allow for the French casement windows to provide a maximum aesthetic open view therethrough when opened as well as easy egress therethrough when needed, all the while providing secure and reliable weathertight seals which are secure from damage during opening and closing of the window sashes.

Still other aspects, objects, and advantages of the present invention can be obtained from a study of the specification, the drawings, and the appended claims.

We claim:

1. An operator for a French casement window having a first window sash supported in a frame by a first hinge and a second window sash supported in said frame by a second hinge, each of said sashes having a first vertical side adjacent the first vertical side of the other sash when said sashes are closed and a second vertical side adjacent the frame when said sash is closed, each of said hinges supporting the associated sash for pivotable movement about a vertical axis on a horizontally slidable hinge shoe, said axis being generally associated with the second vertical side of the sash, said operator comprising:

an operating arm with a roller mounted at an end of said operating arm and movable in an arc between extended and retracted positions as said operating arm moves between window open and closed positions, respectively;

a channel member mountable on said first sash to extend horizontally on said first sash to confine and be engaged by said roller as said operating arm is moved between extended and retracted positions;

a bracket mountable on said second sash adjacent the second vertical side;

a drag link pivotally connected on one end to the bracket and on the other end to said operating arm; and drive means for pivoting said operating arm about a pivot axis;

whereby pivoting of said operating arm moves said roller through said arc to move said first sash between window open and closed positions and further moves said drag link to synchronously move said second sash between window open and closed positions.

2. The operator of claim 1, wherein said drag link is substantially in alignment with the pivot axis of the operating arm when said sashes are closed.

3. The operator of claim 2, wherein said window sashes have an inner side and an outer side with said channel member being mountable to the inner side of the first sash, and further comprising a first sealing flange along the first vertical side of the first sash and adapted to sealingly engage the outer side of the second sash when said sashes are in their closed position, whereby said second sash is closed slightly ahead of the first sash when the sashes are moved to their closed position and said first sash is moved slightly ahead of the second sash when said sashes are moved from their closed position toward their open position.

4. The operator of claim 3, further comprising a second sealing flange along the first vertical side of the second sash and adapted to sealingly engage the inner side of the first sash when said sashes are in their closed position.

5. The operator of claim 1, wherein said drag link is offset from alignment with the pivot axis of the operating arm when said sashes are closed, whereby initial pivoting of the operating arm pulls on said drag link to initiate opening of the second sash.

6. The operator of claim 5, wherein said window sashes have an inner side and an outer side with said channel member being mountable to the inner side of the first sash, and further comprising a first sealing flange along the first vertical side of the second sash and adapted to sealingly engage the outer side of the first sash when said sashes are in their closed position, whereby said first sash is closed slightly ahead of the second sash when the sashes are moved to their closed position and said second sash is moved slightly ahead of the first sash when said sashes are moved from their closed position toward their open position.

7. The operator of claim 6, further comprising a second sealing flange along the first vertical side of the first sash and adapted to sealingly engage the inner side of the second sash when said sashes are in their closed position.

8. In a French casement window having side by side window sashes opening outward from a frame substantially by pivoting of the sashes about their outer vertical sides adjacent to said frame, an operator for moving said window sashes between their open and closed positions comprising:

a pivotable operating arm having a radial end engageable with one of said sashes to move said one sash between open and closed positions;

drive means for pivoting said operating arm about a pivot axis; and a drag link pivotally secured at one end to the operating arm and pivotally secured at its other end to the other sash adjacent the outer vertical side of the other sash;

whereby pivoting of said operating arm synchronously moves both of said window sashes between their open and closed positions.

9. The operator of claim 8, wherein said drive means comprises:

a base secured on the inner side of said frame adjacent the one sash, said base defining the pivot axis of the operator arm;

a driven gear fixed to said operating arm, said driven gear being mounted to said base for pivoting about said pivot axis of the operator arm;

a drive gear pivotally mounted to said base and drivably engaging said driven gear; and means for driving said drive gear.

10. The operator of claim 9, wherein said driving means comprises a handle.

11. The operator of claim 9, wherein said driving means comprises an electric motor unit.

12. The operator of claim 9, further comprising:

a roller on the radial end of the operating arm; and a channel member mountable on said one sash to extend horizontally on said one sash to confine and be engaged by said roller as said operating arm is pivoted to synchronously move both of said sashes between their open and closed positions.

13. The operator of claim 8, wherein said drag link is substantially in alignment with the pivot axis of the operating arm when said sashes are closed.

14. The operator of claim 8, wherein said drag link is offset from alignment with the pivot axis of the operating arm when said sashes are closed, whereby initial pivoting of the operating arm pulls on said drag link to initiate opening of the second sash.

15. An operator for a French casement window having a first window sash supported in a frame by a first hinge and a second window sash supported in said frame by a second hinge, each of said sashes having an inner side, an outer side, a first vertical side adjacent the first vertical side of the other sash when said sashes are closed, and a second vertical side adjacent the frame when said sash is closed, each of said hinges supporting the associated sash for pivotable movement about a vertical axis on a horizontally slidable hinge shoe, said axis being generally associated with the second vertical side of the sash, said operator comprising:

an operating arm with a roller mounted at an end of said operating arm, said operating arm being pivotable about an axis to move in an arc between extended and retracted positions;

a channel member mountable on the inner side of said first sash to extend horizontally on said first sash to confine and be engaged by said roller as said operating arm is moved between its extended and retracted positions to move said first sash between open and closed positions, respectively;

a bracket mountable on the inner side of said second sash adjacent the second vertical side;

a drag link pivotally connected on one end to the bracket and on the other end to said operating arm to move said second sash between open and closed positions synchronously with said first sash when said operating arm is moved between its extended and retracted positions, respectively, said drag link being substantially in alignment with the operating arm pivot axis when said sashes are in their closed position;

a first sealing flange along the first vertical side of the first sash and adapted to sealingly engage the outer side of the second sash when said sashes are in their closed position, a second sealing flange along the first vertical side of the second sash and adapted to sealingly engage the inner side of the first sash when said sashes are in their closed position; and drive means for pivoting said operating arm about a pivot axis;

whereby said second sash is closed slightly ahead of the first sash when the sashes are moved to their closed position and said first sash is moved slightly ahead of the second sash when said sashes are moved from their closed position toward their open position.

16. The operator of claim 15, wherein said drive means comprises:

a base securable to said frame adjacent the inner side of said first sash, said base defining the pivot axis of the operator arm;

a driven gear fixed to said operating arm, said driven gear being mounted to said base for pivoting about said pivot axis of the operator arm;

a drive gear pivotally mounted to said base and drivably engaging said driven gear; and means for driving said drive gear.

17. The operator of claim 16, wherein said driving means comprises a handle.

18. The operator of claim 16, wherein said driving means comprises an electric motor unit.

* * * * *